US010357972B2

(12) United States Patent
Matsuura et al.

(10) Patent No.: US 10,357,972 B2
(45) Date of Patent: Jul. 23, 2019

(54) PRINTER AND WASTE PACK FOR USE IN PRINTER

(71) Applicant: CANON KABUSHIKI KAISHA, Tokyo (JP)

(72) Inventors: Masaaki Matsuura, Kawasaki (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/095,940

(22) Filed: Apr. 11, 2016

(65) Prior Publication Data

US 2016/0303854 A1 Oct. 20, 2016

(30) Foreign Application Priority Data

Apr. 14, 2015 (JP) ..... 2015-082597

(51) Int. Cl.
*B41J 2/165* (2006.01)
*B41J 2/185* (2006.01)

(52) U.S. Cl.
CPC ..... *B41J 2/16523* (2013.01); *B41J 2/16508* (2013.01); *B41J 2/185* (2013.01)

(58) Field of Classification Search
USPC ..... 347/28–36
See application file for complete search history.

(56) References Cited

U.S. PATENT DOCUMENTS 5,157,421 A * 10/1992 Kitahara ..... B41J 2/1721 347/36
5,558,451 A * 9/1996 Hanabusa ..... B41J 13/03 347/104
5,621,450 A * 4/1997 Kawai ..... B41J 2/17533 347/108
5,953,031 A * 9/1999 Omata ..... B41J 2/1721 347/86
6,132,036 A * 10/2000 Abe ..... B41J 2/1721 347/86
6,203,138 B1 * 3/2001 Hirabayashi ..... B41J 2/16523 347/29
6,554,411 B1 * 4/2003 Hatasa ..... B41J 2/17503 347/86
7,018,029 B2 * 3/2006 Ishizawa ..... B41J 2/16523 347/36
7,452,062 B2 * 11/2008 Kimura ..... B41J 2/16523 347/85
7,515,848 B2 * 4/2009 Kitozaki ..... G03G 21/1647 399/110
7,543,925 B2 * 6/2009 Ishizawa ..... B41J 2/17513 347/85

(Continued)

FOREIGN PATENT DOCUMENTS

CN 2749676 Y 1/2006
CN 2837081 Y 11/2006

(Continued)

*Primary Examiner* — Thinh H Nguyen
(74) *Attorney, Agent, or Firm* — Canon U.S.A., Inc. IP Division

(57) ABSTRACT

A waste pack for a printer includes a port, a sealing member configured to seal the port, and an urging member. When the waste pack is attached to the printer, a discharge port of the printer pushes the sealing member and enters the waste pack through the port. When the waste pack is detached, the sealing member urged by the urging member closes the port.

9 Claims, 7 Drawing Sheets

(56) References Cited

U.S. PATENT DOCUMENTS 7,661,790 B2 * 2/2010 Harada ..... B41J 2/185 347/29
7,681,982 B2 * 3/2010 Suzuki ..... B41J 2/16523 347/36
7,810,916 B2 * 10/2010 Hattori ..... B41J 2/17506 347/86
7,976,121 B2 * 7/2011 Harada ..... B41J 2/16523 347/31
8,025,376 B2 * 9/2011 Hattori ..... B41J 2/17513 347/86
8,150,307 B2 * 4/2012 Kudo ..... G03G 15/161 399/360
8,282,198 B2 * 10/2012 Asaki ..... B41J 2/16505 347/36
8,297,734 B2 * 10/2012 Harada ..... B41J 2/185 347/31
8,353,585 B2 * 1/2013 Harada ..... B41J 2/1721 347/36
8,419,173 B2 * 4/2013 Hayashi ..... B41J 2/175 347/31
8,602,522 B2 * 12/2013 Harada ..... B41J 2/1721 347/36
8,857,953 B2 * 10/2014 Suzuki ..... B41J 2/14201 347/65
8,857,959 B2 * 10/2014 Ishida ..... B41J 29/02 347/86
9,028,044 B2 * 5/2015 Harada ..... B41J 2/185 347/36
9,056,498 B2 * 6/2015 Maeyama ..... B41J 11/006
9,132,644 B2 * 9/2015 Harada ..... B41J 2/1721
9,168,756 B2 * 10/2015 Harada ..... B41J 2/1721
9,266,333 B2 * 2/2016 Harada ..... B41J 2/185
9,283,683 B2 * 3/2016 Andrews ..... B25J 15/0616
9,375,935 B2 * 6/2016 Harada ..... B41J 2/16517
9,399,345 B2 * 7/2016 Hirasawa ..... B41J 2/1721
9,539,820 B2 * 1/2017 Ishizawa ..... B41J 2/175
2002/0122104 A1 * 9/2002 Hatasa ..... B41J 2/17513 347/86
2003/0214557 A1 * 11/2003 Nakamura ..... B41J 2/1752 347/49
2005/0041061 A1 * 2/2005 Ishizawa ..... B41J 2/16523 347/36
2006/0017770 A1 * 1/2006 Harada ..... B41J 2/16517 347/36
2007/0008372 A1 * 1/2007 Katada ..... B41J 2/1721 347/36
2007/0035578 A1 * 2/2007 Suzuki ..... B41J 2/16523 347/36
2007/0292179 A1 * 12/2007 Kudo ..... G03G 15/161 399/358
2008/0297575 A1 * 12/2008 Asaki ..... B41J 2/16505 347/86
2009/0179941 A1 * 7/2009 Harada ..... B41J 2/16517 347/31
2009/0218270 A1 * 9/2009 Harada ..... B41J 2/1721 210/236
2009/0218271 A1 * 9/2009 Harada ..... B41J 2/16523 210/236
2009/0219337 A1 * 9/2009 Harada ..... B41J 2/1721 347/36
2009/0219338 A1 * 9/2009 Harada ..... B41J 2/185 347/36
2009/0219339 A1 * 9/2009 Harada ..... B41J 2/1721 347/36
2009/0256884 A1 * 10/2009 Aoki ..... B41J 2/1721 347/23
2010/0074666 A1 * 3/2010 Kudo ..... G03G 15/161 399/360
2011/0254905 A1 * 10/2011 Hayashi ..... B41J 2/175 347/86
2012/0013687 A1 * 1/2012 Ishizawa ..... B41J 2/175 347/85
2012/0236074 A1 * 9/2012 Harada ..... B41J 2/1721 347/36
2014/0176643 A1 * 6/2014 Komaki ..... B41J 2/1721 347/36

FOREIGN PATENT DOCUMENTS

CN 101081568 A 12/2007
CN 101518990 A 9/2009
CN 101618633 A 1/2010
CN 102233739 A 11/2011
JP S639546 A 1/1988
JP H09277546 A 10/1997
JP H1120185 A 1/1999
JP 2000343724 A 12/2000
JP 2002-178542 A 6/2002
JP 2005-131868 A 5/2005
JP 2005-297388 A 10/2005
JP 2006-248153 A 9/2006
JP 2009-269203 A 11/2009
JP 2010-000664 A 1/2010
JP 2010-099856 A 5/2010
JP 2010-155467 A 7/2010
JP 2013-173255 A 9/2013
JP 2014-040044 A 3/2014

* cited by examiner

PRINTER AND WASTE PACK FOR USE IN PRINTER

BACKGROUND OF THE INVENTION

Field of the Invention

The present invention relates to a technique for recovering waste liquid, such as ink and process liquid, in ink-jet printers.

Description of the Related Art

Ink in ink-jet printers that have not been used for a long time can become thick, resulting in the failure of ejection through nozzles. To prevent this, a recovery operation for recovering the state of the nozzles is performed by forcedly absorbing the ink from out of the nozzles. The absorbed ink is disposed of as waste liquid.

A printer disclosed in Japanese Patent Laid-Open No. 2005-131868 includes a container for waste liquid and an opening at the head of the container for receiving the waste liquid dropping from above into the container. The printer further includes an automatic shutter for opening and closing the opening. If the power of the printer is turned off or if the printer is inclined, the shutter is automatically closed to prevent the liquid from leaking through the opening.

However, the configuration disclosed in Japanese Patent Laid-Open No. 2005-131868 is equipped with a large-scale mechanism including a driving source and a gear train for driving the automatic shutter of the container, and it is difficult to achieve size reduction of the printer. Furthermore, since the shutter in the above configuration is exposed from the head of the container by a large amount, the user can touch the shutter by mistake when detaching the container from the printer.

SUMMARY OF THE INVENTION

The present invention provides a printer with a simple configuration for sealing a waste pack to prevent waste liquid from leaking when the waste pack is detached from a printer.

A printer according to an aspect of the present invention includes a discharge port from which waste liquid is discharged and an attaching portion to which a waste pack configured to contain the waste liquid is attached. When the waste pack is attached to the attaching portion, the discharge port enters the waste pack through a port of the waste pack. The waste pack includes a sealing member configured to seal the port and an urging member configured to urge the sealing member in a direction in which the port is closed. When the waste pack is attached to the attaching portion, the discharge port pushes the sealing member and enters the waste pack. When the waste pack is detached from the attaching portion, the sealing member closes the port by urging of the urging member.

Further features of the present invention will become apparent from the following description of exemplary embodiments with reference to the attached drawings.

DESCRIPTION OF THE EMBODIMENTS

Figure 1:
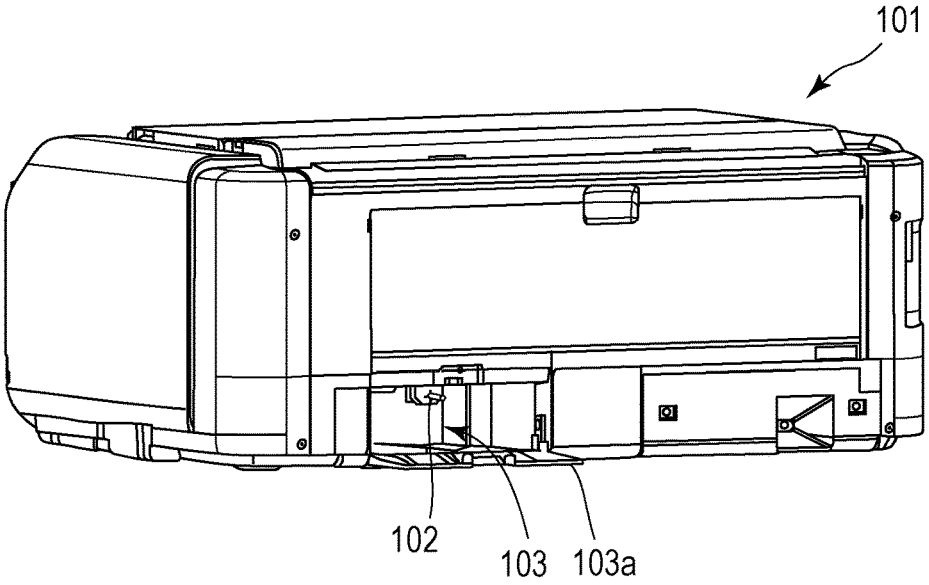
FIG. 1 is a perspective view of a printer according to an embodiment of the present invention illustrating the appearance thereof.
Figure 2:
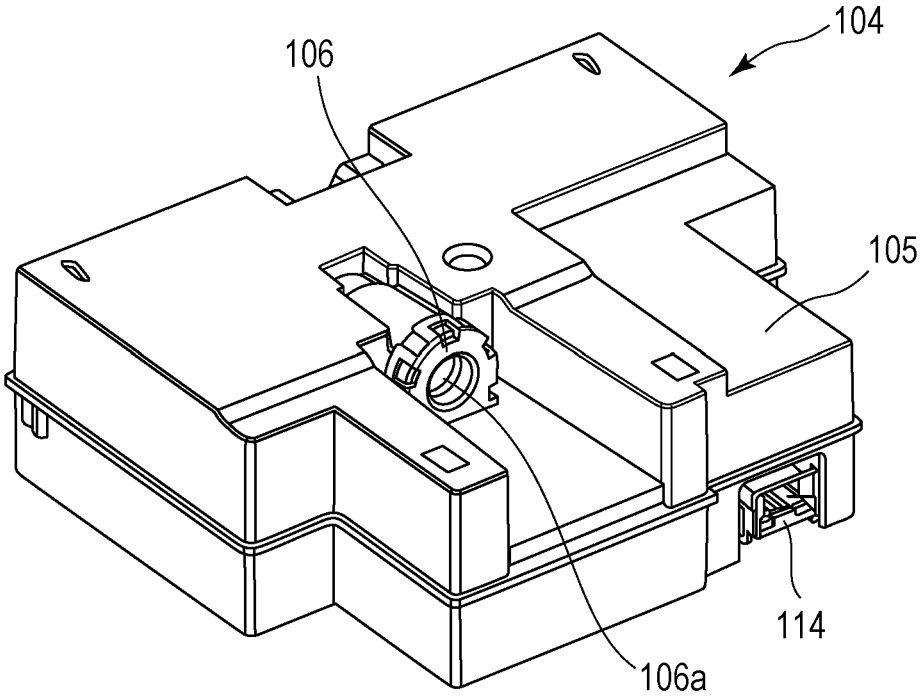
FIG. 2 is a perspective view of a waste pack illustrating the appearance thereof.

FIG. 1 is a perspective view of a printer 101 according to an embodiment of the present invention illustrating the appearance thereof. FIG. 2 is a perspective view of a waste pack 104 illustrating the appearance thereof. The printer 101 accommodates an ink-jet printing unit. As a printing operation is performed, waste liquid, such as ink forcedly absorbed through nozzles, waste ink from a print head, and the rest of treatment liquid applied to printing paper, is generated. The printer 101 includes a discharge duct 102 through which the waste liquid is discharged and an attaching portion 103 to which a detachable cartridge waste pack 104 (a liquid container) is to be attached. The waste pack 104 is to contain waste liquid discharged through the discharge duct 102.

The user of the printer 101 opens a small cover 103*a* disposed at the lower front of the printer 101 toward the front, as shown in FIG. 1, and attaches the cartridge waste pack 104 by pushing it toward the back of the attaching portion 103 and detaches the cartridge waste pack 104 by drawing it toward the front. When the waste pack 104 has become full of waste liquid, the user detaches the waste pack 104 and replaces it with a new unit.

As shown in FIG. 2, the waste pack 104 is such that an opening unit 106 having a port 106*a* for receiving the waste liquid is disposed on a container 105 having an interior space, which is made by resin molding. The port 106*a* of the opening unit 106 is oriented so that the discharge duct 102 of the printer main body is horizontally inserted into the waste pack 104 in a horizontal position. The container 105 has a shape in which part of the top of the container 105 is cut out along the orientation of the port 106*a* so as not to physically interfere with the discharge duct 102 when the waste pack 104 is attached to the attaching portion 103. As described later, the discharge duct 102 is given a force that pushes the sealing cover 103*a* into the container 105, and the discharge duct 102 has sufficient rigidity not to be deformed by the force.

The waste pack 104 further includes an electrical connector 114, with which the waste pack 104 is electrically connected to a main body controller in the printer 101. The waste pack 104 further includes a sensor for detecting the amount of waste liquid accumulated (or a remaining capacity) and an IC tag indicating an ID unique to the waste pack 104. The information is transmitted to the main body controller via the connector 114.

Figure 3:
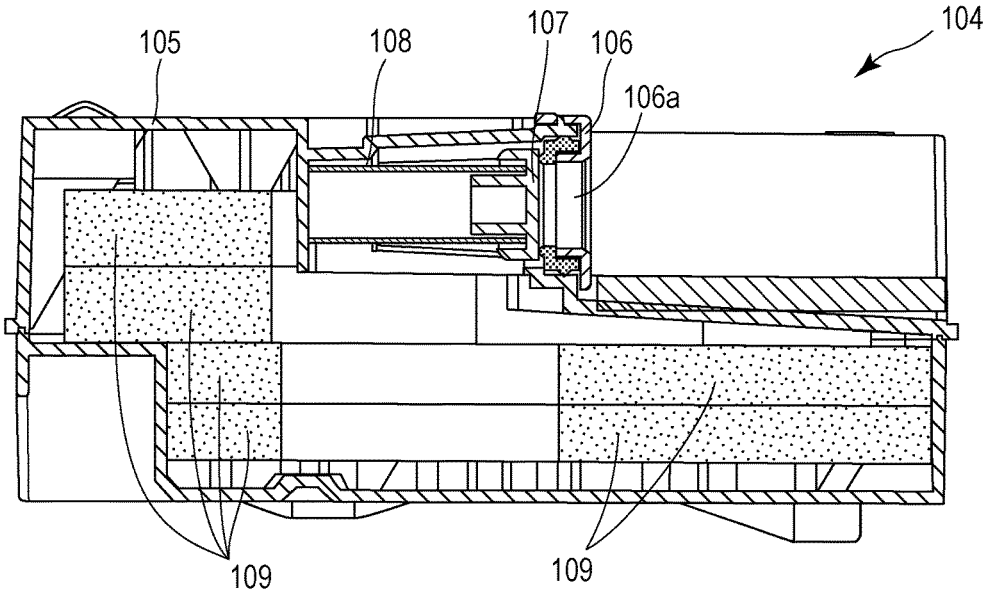
FIG. 3 is a cross-sectional view of the waste pack illustrating the structure in an unattached state.
Figure 4:
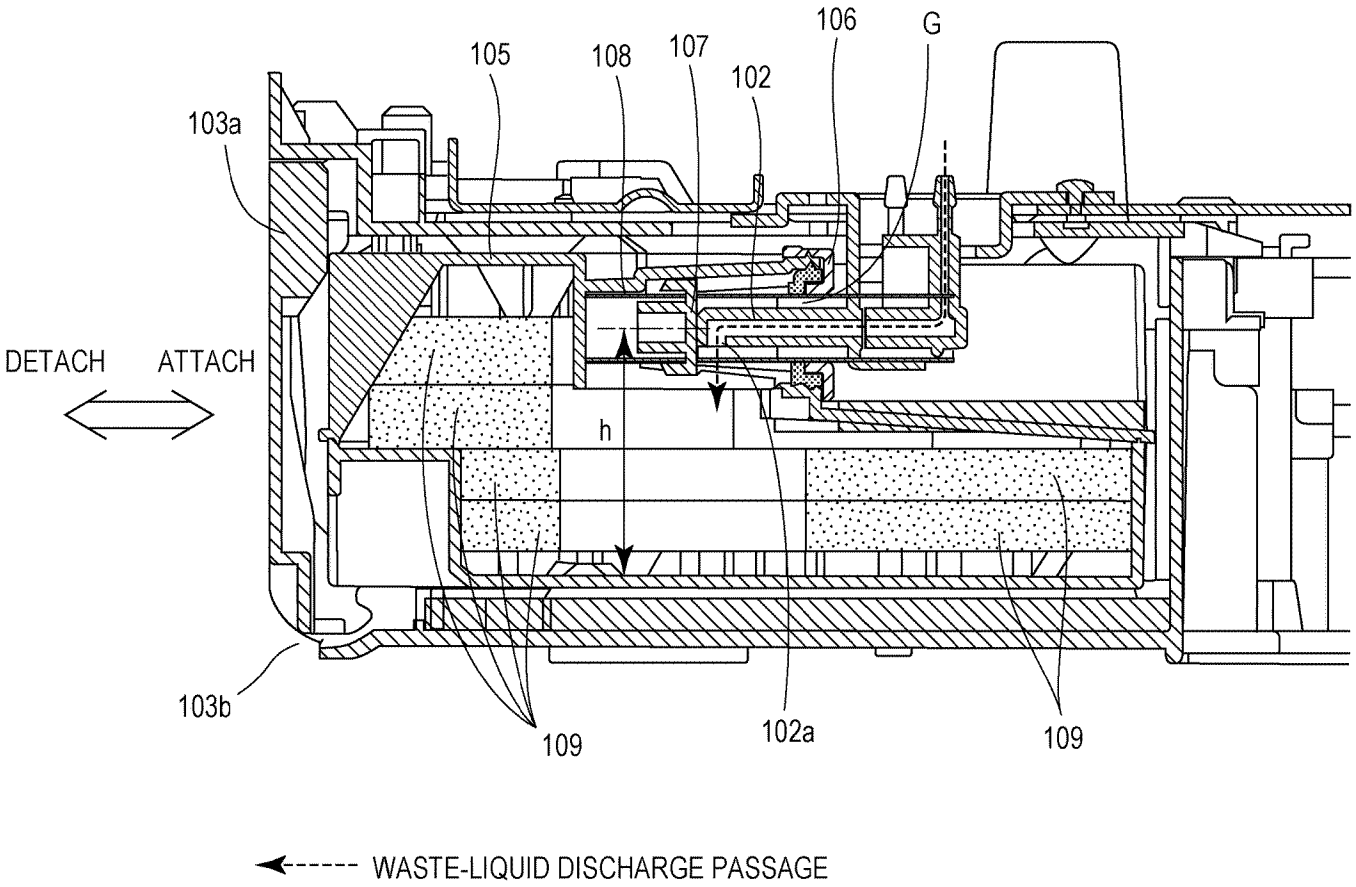
FIG. 4 is a cross-sectional view of the waste pack and a discharge duct illustrating engagement in an attached state.
Figure 5B:
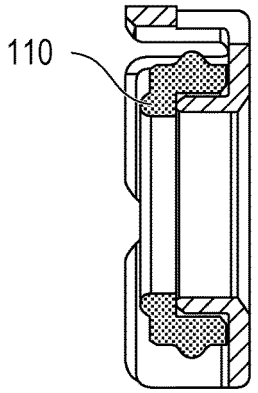
FIG. 5B is a cross-sectional view taken along line VB-VB in FIG. 5A.
Figure 5A:
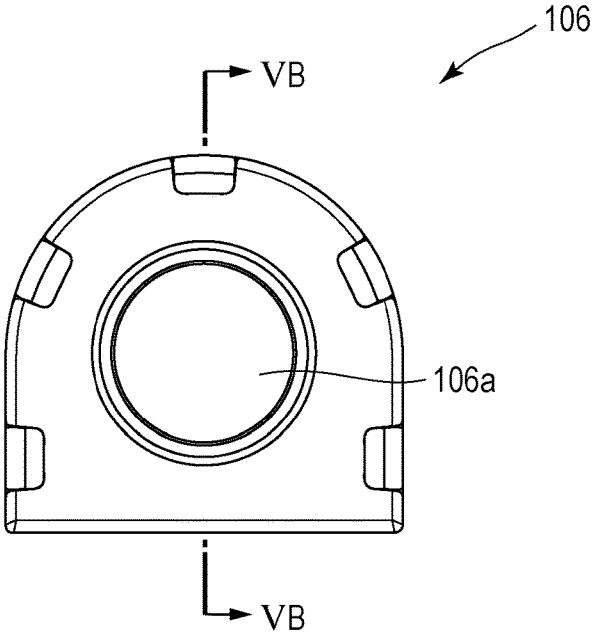
FIG. 5A is a front view of an opening unit illustrating the configuration thereof.

FIG. 3 is a cross-sectional view of the waste pack 104 illustrating the structure in an unattached state. FIG. 4 is a cross-sectional view of the waste pack 104 and the discharge duct 102 illustrating engagement in an attached state. FIG. 5A is a front view of the opening unit 106 illustrating the structure thereof, and FIG. 5B is a cross-sectional view taken along line VB-VB in FIG. 5A.

As shown in FIGS. 3 and 4, the container 105 of the waste pack 104 includes absorbers 109 for absorbing liquid and holding it in such a manner as to be stacked in layers from the bottom. The absorbers 109 are made of a highly absorbent material, such as porous sponge. As shown in FIGS. 5A and 5B, the opening unit 106 has the port 106*a* as a through-hole. A ring-shaped sealing member 110 in contact with a sealing cover 107 is disposed around the opening unit 106 adjacent to the interior of the container 105.

In an unattached state in which the waste pack 104 is detached from the printer 101, as shown in FIG. 3, the sealing cover 107 (a sealing member) is pushed and urged to the port 106*a* by an elastic member 108 (an urging member) having an elastic force, such as a spring. The port 106*a* is tightly sealed by the sealing cover 107 to create an airtight seal so as to block outside air from the interior of the container 105 of the waste pack 104.

To attach the waste pack 104 to the printer 101, the user opens the cover 103*a* at the front of the printer 101 toward the front (see FIG. 1) and pushes the waste pack 104 backward (in the direction of arrow ATTACH in FIG. 4). In other words, the cover 103*a* is disposed at a position of the casing of the printer 101 corresponding to the attaching portion 103, and the user attaches the waste pack 104 by opening the cover 103*a* and inserting the waste pack 104 into the attaching portion 103. After the attachment is complete, the user closes the cover 103*a*. The orientation of the vicinity of a discharge port 102*a* of the discharge duct 102 is the same (or substantially the same) as the direction of insertion of the waste pack 104. To detach the waste pack 104 from the printer 101, the user opens the cover 103*a* toward the front and draws the waste pack 104 toward the front (in the direction of DETACH in FIG. 4). When the waste pack 104 is inserted, an end of the discharge duct 102 comes into contact with the vicinity of the center of the surface of the sealing cover 107 to bring the sealing cover 107 further backward from the port 106*a* against the urging force of the elastic member 108. The sealing cover 107 is slid deep into the waste pack 104 and is separated from the port 106*a*, and the end of the discharge duct 102 is also inserted deep into the waste pack 104. At that time, the discharge port 102*a* around the end of the discharge duct 102 is positioned deep in the container 105. This prevents bubbles of bubbly waste liquid discharged from the discharge port 102*a*, even if they burst and splatter, from leaking out of the container 105 through the port 106*a*.

When the waste pack 104 is inserted, the connector 114 of the waste pack 104 is electrically connected to a connector at the back of the attaching portion 103 of the printer 101. In other words, the insertion of the waste pack 104 establishes the connection between the discharge duct 102 and the port 106*a* and the electrical connection of the connector 114. When the waste pack 104 is drawn out of the attaching portion 103, the above components are disconnected.

The discharge port 102*a* is a downward through-hole around the end of the discharge duct 102 around the outer circumferential surface of the discharge duct 102, and the discharge duct 102 has no hole at the end. This prevents the waste liquid in the discharge duct 102 from attaching to the surface of the sealing cover 107 to soil it when the end of the discharge duct 102 comes into contact with the surface of the sealing cover 107. The waste liquid flowing through the discharge duct 102 along the dotted arrow "WASTE-LIQUID DISCHARGE PASSAGE" in FIG. 4 is discharged from the discharge port 102*a* downward in the direction of gravity. Most of the discharged waste liquid is bubbly and drops from the height "h" in the waste pack 104 and is absorbed by the absorbers 109 disposed to surround the drop position.

The outside diameter of the cylindrical discharge duct 102 is smaller than the diameter of the port 106*a* to form a gap G with a ring-shaped cross section between the port 106*a* and the discharge duct 102. The interior of the container 105 of the waste pack 104 communicates with the air (the interior space of the printer 101) through the gap G, so that the pressure in the container 105 is equal to the atmospheric pressure.

When the waste pack 104 is detached from the printer 101, the port 106*a* is tightly sealed with the sealing cover 107 by the urging of the elastic member 108 to bring the interior of the container 105 into a sealed state isolated from the outside air. Thus, even if the user tilts or drops the used waste pack 104 by mistake when replacing the waste pack 104, leakage of the waste liquid contained in the waste pack 104 can be prevented.

When the waste pack 104 is attached to the printer 101, the interior of the container 105 communicates with the air, and the liquid held in the absorbers 109 is gradually decreased by evaporation, so that the total waste liquid capacity over a long time is increased. This reduces the frequency of replacement of the waste pack 104. In other words, even if the capacity of the waste pack 104 is decreased, a sufficient amount of waste liquid can be held. Furthermore, since the absorbers 109 hold the waste liquid in the waste pack 104 to prevent generation of a waste liquid pool, no sound is generated and little liquid leaks even if the printer 101 is shaken.

Furthermore, when the waste pack 104 is to be replaced, the cover 103*a* is opened in such a manner as to be rotated around a lower hinge 103*b* to come down to the front. Therefore, in case a little waste liquid drips from the opening unit 106 of the waste pack 104, the cover 103*a* serves as a receiver to receive the dripped waste liquid, thus preventing a floor on which the printer 101 is installed from being soiled.

A modification of the opening unit 106 of the waste pack 104 will be described. To reduce the size of the printer 101, the waste pack 104 also needs to be reduced in size as much as possible. However, reducing the size of the waste pack 104 will reduce the size of the interior space of the container 105 to decrease the distance between the inserted discharge duct 102 and the bottom of the waste pack 104 (the distance h shown in FIG. 4). If the discharged waste liquid is bubbly, most of the liquid components are absorbed by the absorbers 109, but part could be accumulated in the container 105 in the bubbly state without bursting. When the thus-accumulated bubbles reach the discharge duct 102, the bubbles could leak out of the container 105 through the gap G between the port 106*a* and the discharge duct 102.

Figure 6B:
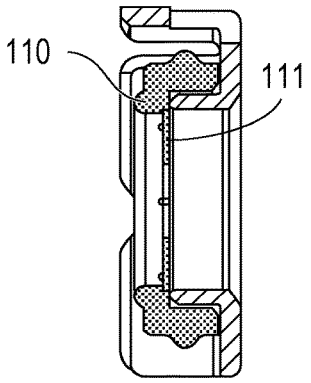
FIG. 6B is a cross-sectional view taken along line VIB-VIB in FIG. 6A.
Figure 6A:
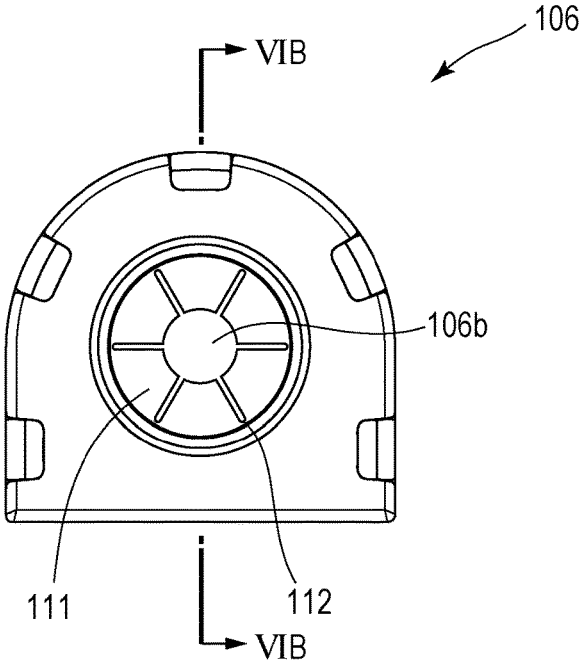
FIG. 6A is a front view of an opening unit according to a modification illustrating the structure thereof.

The structure of the opening unit 106 shown in FIGS. 6A and 6B prevents such a situation. Unlike the structure shown in FIGS. 5A and 5B, a flexible sealer 111 is attached to the opening unit 106 to loosely seal the gap G between the inserted discharge duct 102 and the opening unit 106. A small opening 106*b* is provided inside the sealer 111. When the discharge duct 102 is inserted into the opening 106*b*, the sealer 111 comes into contact with the outer circumferential surface of the discharge duct 102 to be elastically deformed. The sealer 111 has a plurality of (in this example, six) slits 112 in a radial pattern to facilitate the elastic deformation and the communication with the air. Although the air communicates through the slits 112, the bubbly liquid hardly passes through the slits 112 with a small width. This prevents the bubbly waste liquid from flowing backward to leak out of the opening 106*b*. The waste pack 104 thus communicates with the air through the slits 112 to promote evaporation of the waste liquid in the container 105.

The printer 101 of this embodiment further includes an airflow supply unit 113 that forcedly blows gas to further efficiently promote evaporation of the waste liquid in the container 105 of the waste pack 104.

Figure 7:
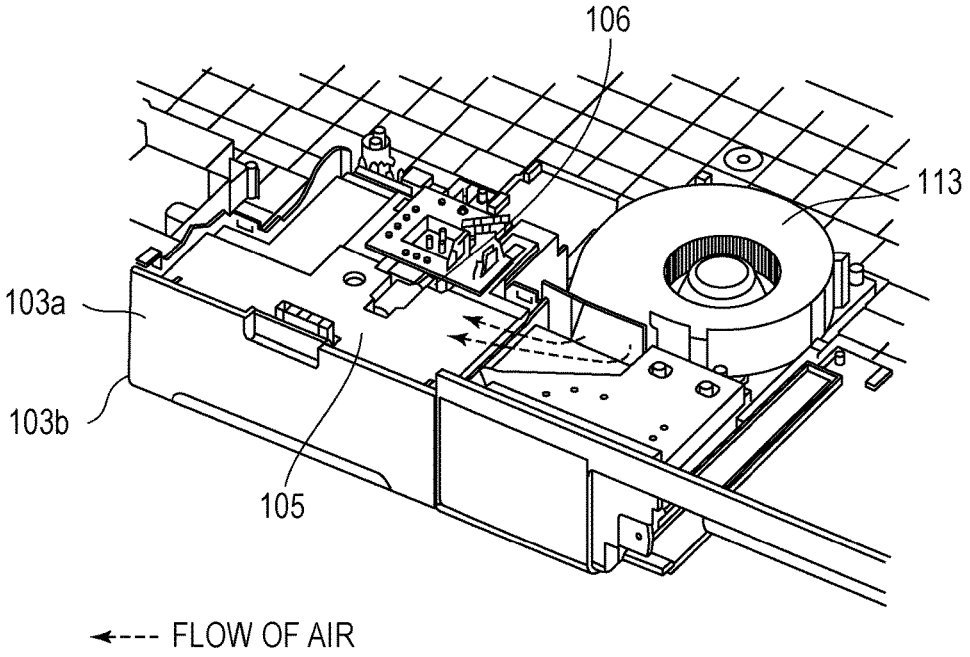
FIG. 7 is a perspective view of an airflow supply unit illustrating the structure thereof.

FIG. 7 is a perspective view of the airflow supply unit 113 illustrating the structure thereof. The airflow supply unit 113 includes a fan and an air duct. An airflow generated with the fan is directed to a desired direction with the air duct. The airflow is blown to the vicinity of the opening unit 106 of the waste pack 104 to which the airflow supply unit 113 is attached, as indicated by the arrows in FIG. 7 and is discharged out of the printer 101 by itself. This prevents air saturated with water vapor from stagnating around the opening unit 106, further promoting the evaporation in the waste pack 104.

The above-described embodiment prevents leakage of liquid from a waste pack detached from a printer with a simple configuration. Since the interior of the container communicates with the air through a gap around the opening, with the waste pack attached, and the waste liquid in the waste pack evaporates with time, the substantial period of use is extended, providing a long-life printer that needs no replacement of the waste pack for a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-082597, filed Apr. 14, 2015, which is hereby incorporated by reference herein in its entirety.

What is claimed is:

1. A printer comprising:

a print unit configured to perform printing by discharging liquid;

a horizontal duct for discharging liquid discharged from the print unit, the horizontal duct including:

a cylindrical body having an outer circumferential surface; and a discharge port provided downwardly through an underside portion of the outer circumferential surface;

wherein an end of the cylindrical body adjacent to the discharge port is enclosed; and a waste pack to be detachably attached to an attaching portion of the printer, the waste pack configured to contain liquid to be discharged from the discharge port of the horizontal duct when the waste pack is attached to the attaching portion, wherein the waste pack includes:

an opening port into which the horizontal duct is inserted when the waste pack is attached;

a sealing member movable to a first position at which the opening port is sealed by being urged by an urging member and to a second position at which the opening port is not sealed, wherein, in response to the waste pack being attached to the attaching portion, the sealing member is pushed by the horizontal duct and is moved from the first position to the second position; and an elastic member disposed in front of the sealing member in a direction in which the waste pack is attached, wherein the elastic member has slits in a radial pattern.

2. The printer according to claim 1, further comprising an airflow supply unit configured to supply airflow toward the opening port.

3. The printer according to claim 1, wherein the discharge port extends from an inside of the cylindrical body to the outer circumferential surface of the cylindrical body, and the discharge port does not come into contact with the sealing member.

4. The printer according to claim 1, further comprising a cover movable to a closed position at which the attaching portion is covered and to a opened position at which the waste pack is attachable to and detachable from the attaching portion.

5. The printer according to claim 4, wherein the cover is provided in a front side of the printer and is rotatably opened about a hinge provided at a bottom of the cover.

6. The printer according to claim 1, wherein the waste pack includes an electrical connector which is electrically connected to a connector provided to the attaching portion when the waste pack is attached to the attaching portion.

7. The printer according to claim 1, wherein an outer circumferential diameter of the horizontal duct is smaller than an inner circumferential diameter of the opening port, and a ring-shaped gap is formed between the horizontal duct and the opening port.

8. The printer according to claim 1, wherein the waste pack further comprises an absorber which contains liquid discharged from the horizontal duct.

9. The printer according to claim 8, wherein the absorber has a shape surrounding a drop position to which liquid is discharged from the discharge port.

* * * * *